US009478336B2

(12) United States Patent
Henning, III

(10) Patent No.: US 9,478,336 B2
(45) Date of Patent: Oct. 25, 2016

(54) SPINNING MAGNET APPARATUS

(71) Applicant: OnyxIP, Inc., Huntsville, AL (US)

(72) Inventor: Harvey S. Henning, III, Toney, AL (US)

(73) Assignee: OnyxIP, Inc., Huntsville, AL (US)

( * ) Notice: Subject to any disclaimer, the term of this patent is extended or adjusted under 35 U.S.C. 154(b) by 0 days.

(21) Appl. No.: 14/688,740

(22) Filed: Apr. 16, 2015

(65) Prior Publication Data

US 2015/0302965 A1 Oct. 22, 2015

Related U.S. Application Data

(60) Provisional application No. 61/981,615, filed on Apr. 18, 2014.

(51) Int. Cl.
*H01F 7/02* (2006.01)

(52) U.S. Cl.
CPC ..... *H01F 7/0242* (2013.01)

(58) Field of Classification Search
CPC ..... A63H 33/26; H01F 7/0236
USPC ..... 335/306, 291, 285
See application file for complete search history.

(56) References Cited

U.S. PATENT DOCUMENTS 3,196,566 A * 7/1965 Littlefield ..... G09F 19/12 335/295
3,425,157 A * 2/1969 Hartsock ..... A63H 33/26 446/134
3,478,466 A * 11/1969 Conner ..... A63H 33/26 273/456
3,955,315 A * 5/1976 Goodman ..... A63H 33/26 446/133
4,250,659 A * 2/1981 Ishiguro ..... A63H 13/12 273/456
4,568,301 A * 2/1986 Hawley, Jr. ..... A63H 33/26 446/134
5,052,968 A * 10/1991 Lodrick, Sr. ..... A63H 33/26 446/134
5,060,947 A * 10/1991 Hall ..... A63F 9/34 273/138.2
5,589,721 A * 12/1996 Han ..... G09F 9/375 310/90.5
5,842,902 A * 12/1998 Liff ..... A63H 33/26 446/130
5,881,679 A * 3/1999 Hann ..... A01K 15/025 119/707
6,761,610 B2 * 7/2004 Fisher ..... A63H 33/26 335/306
7,264,248 B2 * 9/2007 Stoddart ..... A63B 67/10 273/456
8,258,663 B2 * 9/2012 Smoot ..... H02N 15/00 310/90.5
2011/0140819 A1 * 6/2011 Kazadi ..... F16C 32/0429 335/285

* cited by examiner

*Primary Examiner* — Alexander Talpalatski
(74) *Attorney, Agent, or Firm* — Ann J. Dennen

(57) ABSTRACT

An apparatus of the present disclosure has a first magnet coupled to a frame and a position of the first magnet vertically adjustable and a second magnet coupled to the frame and positioned and arranged in vertical alignment with the first magnet along a magnetic axis common to the first and second magnets, such that the first magnet is free to rotate about the magnetic axis. The spinning magnet apparatus demonstrates that the external magnetic field caused by the magnets is not fixed to the material matrix of the magnets.

13 Claims, 1 Drawing Sheet

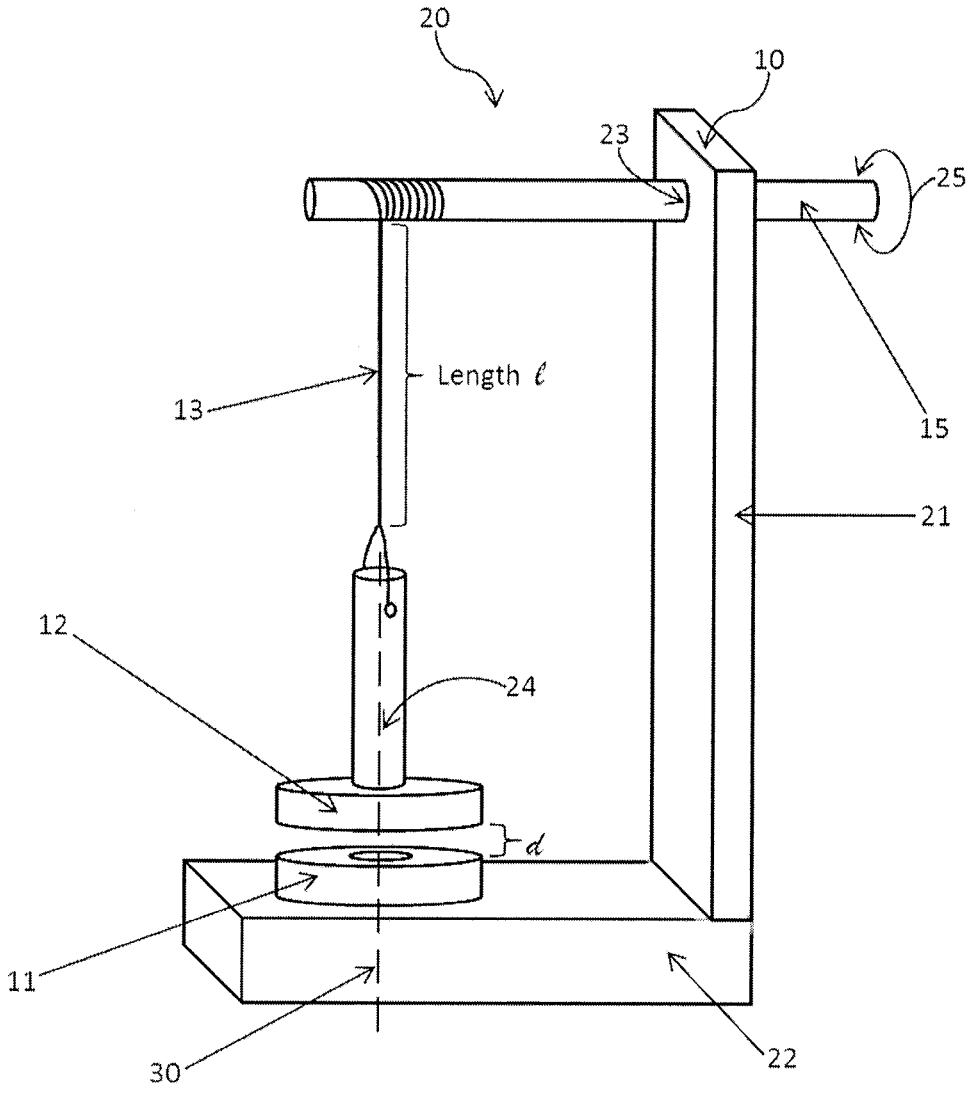
20
10
23
25
Length ℓ
13
15
21
12
24
d
11
30
22

SPINNING MAGNET APPARATUS

CROSS-REFERENCE TO RELATED APPLICATION

This application claims priority to U.S. Provisional Patent Application Ser. No. 61/981,615, entitled Spinning Magnet Apparatus and filed on Apr. 18, 2014, which is incorporated by reference in its entirety.

BACKGROUND

Michael Faraday was a scientist of the 1800s. His work contributed to the field of electromagnetism, among other scientific principles. Important to the present disclosure, Faraday proposed the law of electromagnetic induction, based upon his observations of current induced in a conductor when exposed to magnetic fields. Simply stated, Michael Faraday's proposition of electromagnetic induction was that exposure to a change in magnetic flux produces current in the conductor.

In Faraday's work, he created a homopolar generator, which is a direct current (DC) electrical generator. The homopolar generator consisted of an electrically conductive disc that rotated in a plane perpendicular to a static magnetic field. The rotation in the magnetic field created a current flow in the conductive disc.

Based upon Faraday's research, the current produced was a result of the conductive disc breaking the lines of magnetic flux emanating from the magnet. However, Faraday found that when both the conductive disc and the magnet were coupled and rotated together, current was still induced in the conductive disc. This has been historically referred to as the "Faraday Paradox." Thus, there are situations in which Faraday's law of electromagnetic induction does not appear to predict accurate results.

The question then becomes does external magnetic flux rotate or remain axially fixed in the homopolar generator. Faraday's opinion in 1831 was that the flux remained fixed as the disk and magnet rotated; however, today academia is still undecided.

SUMMARY OF THE PRESENT DISCLOSURE

An apparatus of the present disclosure has a first dowel rotatably coupled on a first end to a frame and on a second end to a first magnet, a position of the first magnet vertically adjustable when the dowel is rotated. The apparatus further has a second magnet coupled to the frame and positioned and arranged in vertical alignment with the first magnet along a magnetic axis common to the first and second magnets, such that the first magnet is free to rotate about the magnetic axis.

BRIEF DESCRIPTION OF THE DRAWINGS

The present disclosure can be better understood with reference to the following drawing. The elements of the drawing are not necessarily to scale relative to each other, emphasis instead being placed upon clearly illustrating the principles of the disclosure.

FIG. 1 is an isometric view of the Spinning Magnet Apparatus according to an exemplary embodiment of the present disclosure.

DETAILED DESCRIPTION

A spinning magnet apparatus 20 in accordance with an embodiment of the present disclosure is shown in FIG. 1.

The spinning magnet apparatus 20 demonstrates an answer to Faraday's Paradox. In this regard, if the magnetic lines of force are fixed to the material matrix of the magnets then the two magnets in proximity would mesh like a set of gears. However, if Faraday was right in his postulation that the flux outside the magnet does not rotate, then the upper magnet would spin freely with no parasitic loss imposed by the lower magnet. The latter behavior is indeed what is observed when this device is placed in operation.

The spinning magnet apparatus 20 comprises a right angle upright frame 10. The right angle upright frame 10 comprises a horizontal leg 22 and a vertical leg 21 constructed at a right angle. Note that the right-angled from in FIG. 1 is for exemplary purposes. In this regard, the frame could be constructed such that the legs 21 and 22 are at different angles than a right angle. In addition, the frame 10 may take on other shapes, for example, in one embodiment, the frame may be a circular shape.

The vertical leg 21 is coupled to a dowel 15. In the embodiment shown, the dowel 15 is mounted to an opening 23 at the top of the vertical leg 21. In one embodiment, the dowel 15 is rotatably affixed to the vertical leg 21.

A magnet 11 is fixedly coupled to the horizontal leg 22. In one embodiment, the magnet 11 is glued via an epoxy to the horizontal leg 22.

Further, a suspension thread 13 is wrapped around the dowel 15 and coupled to a magnet 12. Thus, the magnet 12 is suspended above the fixed magnet 11. As shown, the magnets 11 and 12 are arranged in attraction and aligned along a magnetic axis 30.

In one embodiment, the thread 13 is coupled to a dowel 24. In such an embodiment, the dowel 24 is fixedly coupled to the magnet 12 such that the magnet 12 is suspended above magnet 11 in attraction and aligned along the magnetic axis 30.

Note that in one embodiment, the thread 13 is a spun cotton thread. However, the thread 13 may be made of other materials known in the art or future-developed.

In operation, attraction force of the magnets 11 and 12 places tension on the thread 13. This tension causes the thread 13 to unwind and to apply a small rotational torque to the upper suspended magnet 12. The rotational torque causes the upper suspended magnet 12 to rotate, which it does freely with no parasitic or induced drag.

In one embodiment, the dowel 15 can rotate in a direction as indicated by reference arrow 25. When rotated either clockwise or counter clockwise, a length l of the suspension thread 13 may increase or decrease, which depends upon the direction that the dowel is twisted. When length l is adjusted by twisting the dowel 15, physical separation distance d between the two magnets 11 and 12 increases or decreases accordingly. Thus, the torque applied by the tension on the thread 13 adjusts accordingly.

From the above description, the spinning magnet apparatus 20 provides a method whereby the relationship between the magnets and the external magnetic flux caused by said magnets can be demonstrated.

In one embodiment, the spinning magnet apparatus 20 may be used as an experimental apparatus to explain Faraday's Paradox, as described hereinabove. In another embodiment, the spinning magnet apparatus 20 may be used as a game or novelty item.

The foregoing discussion discloses and describes exemplary methods and embodiments of the present disclosed disclosure. The disclosure is intended to be illustrative, but not limiting, of the scope of the apparatuses and methods, which are set forth in the following claims.

What is claimed is:

1. An apparatus, comprising:

a first magnet coupled to a frame and at a position wherein the first magnet is vertically adjustable, the frame comprising a vertical leg and a horizontal leg;

a second magnet coupled to the horizontal leg of the frame and positioned and arranged such that the first magnet is suspended directly above the second magnet and centrally aligned with the second magnet along a vertical magnetic axis that is parallel with the vertical leg and is common to the first and second magnets and centrally and vertically extending through the center of the first and second magnets, such that the first magnet is free to rotate radially about the vertical magnetic axis.

2. The apparatus of claim 1, further comprising a first dowel rotatably coupled on a first end to the frame and on a second end to the first magnet such that the position of the first magnet is adjustable by rotation of the first dowel.

3. The apparatus of claim 2, further comprising a suspension thread coupled to the second end of the first dowel and to the first magnet.

4. The apparatus of claim 3, wherein a length of the suspension thread adjusts when the dowel rotates.

5. The apparatus of claim 4, further comprising a second dowel coupled to an end of the suspension thread and coupled to the magnet such that the first magnet is freely rotatable.

6. The apparatus of claim 2, wherein the first dowel is rotatably coupled to a vertical leg of the frame.

7. The apparatus of claim 6, wherein the second magnet is coupled to a horizontal leg of the frame.

8. The apparatus of claim 1, wherein the apparatus is used to demonstrate an interaction of a first and second magnetic field of the first and second magnets.

9. The apparatus of claim 1, wherein the apparatus is used to demonstrate that a magnetic field of the first magnet is not fixed to a material matrix of the first magnet.

10. The apparatus of claim 1, wherein the first and second magnets are separated and aligned vertically in attraction and the and the second magnet is fixed and the first magnet is freely suspended rotating about the magnetic axis.

11. The apparatus of claim 1, wherein first magnet is coupled to the frame via a spun cotton suspension thread.

12. The apparatus of claim 11, wherein the cotton suspension thread provides rotational torque when placed under stress by the first and second magnets.

13. The apparatus of claim 1, wherein the first and second magnets are toroid-shaped, and ceramic.

* * * * *